United States Patent [19]

Karron

[11] 4,025,722

[45] May 24, 1977

[54] METHOD AND APPARATUS FOR RECORDING

[76] Inventor: Leo Karron, 154-18 17th Road, Whitestone, N.Y. 11357

[22] Filed: Mar. 10, 1976

[21] Appl. No.: 665,724

[52] U.S. Cl. ..... 179/1 P; 179/1 F

[51] Int. Cl.[2] ..... H04R 3/04

[58] Field of Search ..... 179/1 P, 1 H, 1 F, 115.5 R, 179/115.5 DV, 115.5 VC

[56] References Cited

UNITED STATES PATENTS

| | | | |
|---|---|---|---|
| 2,007,748 | 7/1935 | Olson | 179/115.5 VC |
| 2,155,807 | 4/1939 | Stimson | 179/1 P |
| 2,972,018 | 2/1961 | Hawley et al. | 179/1 P |
| 3,798,374 | 3/1974 | Myers | 179/1 F |

*Primary Examiner*—Kathleen H. Claffy
*Assistant Examiner*—E. S. Kemeny
*Attorney, Agent, or Firm*—Bauer, Amer & King

[57] ABSTRACT

The apparatus and method for making of recordings before a live audience where the performance is electrically amplified, utilizes a secondary winding coupled to a speaker voice coil for coupling to a recorder signals which represent the performers audio signals without the presence of audience noise. The speaker diaphragm and voice coil is utilized to generate a signal responsive to audience noise for cancellation of audience noise signals picked up by the amplifier system.

4 Claims, 2 Drawing Figures

METHOD AND APPARATUS FOR RECORDING

FIELD OF THE INVENTION

This invention relates to sound recording methods and apparatus and, in particular, to improved loud speaker devices.

BACKGROUND OF THE INVENTION

Attendees at lectures and other public performances frequently desire to record the performance on portable recorders located in the audience area. Generally, the resultant recordings are often of disappointingly poor quality because of background noise arising from the audience. Locating the recorder near the performer has not proved a solution to the problem.

There is disclosed in U.S. Pat. No. 3,322,879 issued May 30, 1967, to E. G. Vozeolas et al, the use of an inductive pick-up coupled to the receiver of a telephone handset to permit recording of telephone conversations.

In one embodiment the inductive pick-up is indicated as coupled to the voice coil, however, the inductive coil is shown surrounding a magnetic core and accordingly, would be shielded against signal pick-up. The patent does suggest that the pick-up coil can be placed in front of the speaker. However, there is no teaching of how the concept can be utilized to make recordings in a theater or auditorium.

SUMMARY OF THE INVENTION

A method and apparatus for recording a live performance utilizing an amplified sound system for amplifying the performer's audio sound.

A secondary winding is provided within the magnetic field generated by the voice coil of a speaker. The secondary winding thus detects signals present in the voice coil arising from several sources. The sources include the primary signal produced by the amplification of the performer's audio signals and applied to the voice coil, the amplification of the audience noise picked up by the performer's microphone, amplified and also applied to the voice coil, and back e.m.f. generated by the audience noise actuating the speaker cone which tends to cancel the amplified audience noise signal.

Accordingly, it is an object of this invention to provide an improved recording method for recording of live performances before an audience.

A further object of this invention is to provide a method of making a recording before a live audience, which eliminates background noise.

A still different object is to provide an improved apparatus for recording of live performances.

Another object is to provide an improved apparatus for the simultaneous making of a plurality of recordings before live audience.

Still a further object of the invention is to provide an improved speaker equipped with a secondary winding for recording of electrical signals.

The above description, as well as further objects, features and advantages of the present invention, will be more fully appreciated by reference to the following detailed description of a presently preferred, but, nonetheless illustrative, embodiment in accordance with the present invention, when taken in conjunction with the accompanying drawings.

IN THE DRAWING

FIG. 1 is a schematic showing of a sound amplification system and recording apparatus; and FIG. 2 is a schematic showing of a sound amplification system having means for simultaneous making of a plurality of recordings.

DESCRIPTION OF THE PREFERRED EMBODIMENT

Figure 1:
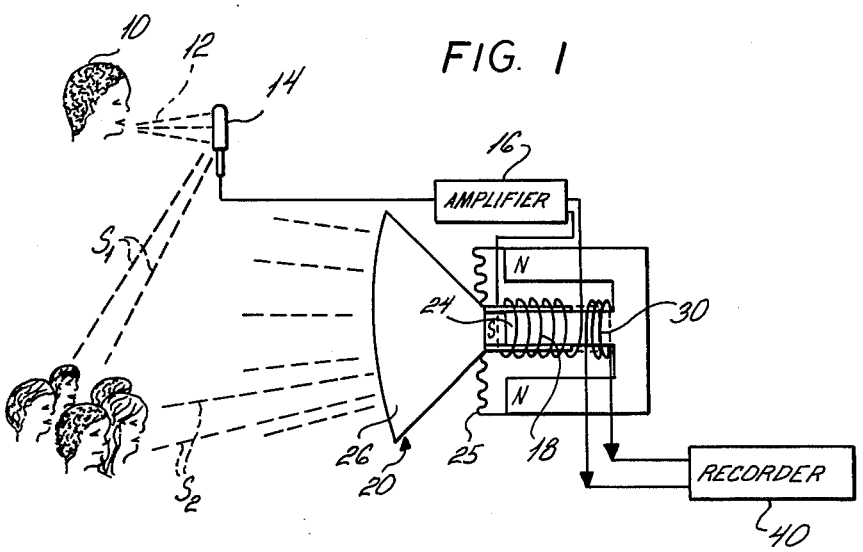

Reference is now made in FIG. 1 of the drawing wherein reference numeral 10 represents a performer emitting audio signals 12 which are picked up by microphone 14 and converted into electrical signals, which are amplified by amplifier 16 and applied to voice coil 18 of speaker 20.

As is well known, the electrical signals generate a magnetic field surrounding the coil which reacts with the field emanating from the magnetic field of the pole piece 24 of the speaker causing the speaker cone 26 to move in accordance with the electrical signal to thereby convert the electrical signals into audio signals.

It has been found that if a pick-up coil such as employed in a telephone pick-up is positioned close to the speaker voice coil to detect the electrical signals, an extremely clear noise-free recording is obtained.

It has been postulated that this surprising result is achieved because a portion of the sound signals $S_1$ from the audience is picked up by the microphone 14, amplified and applied to the voice coil 18 while a portion of sound signals $S_2$ is picked up by the cone of the speaker.

The audio signal $S_2$ moves the voice coil 18 through the magnetic field generated by pole piece 24. This results in a signal being generated which is opposite in phase to that produced by the amplification of signal $S_1$ through the amplifier 16. The opposed signals are detected by auxiliary winding 30, preferably on the same core member as that traversed by the voice coil 18. The voice coil is maintained in a floating condition around the core member by a corrugated flexible support disc 25.

Figure 2:
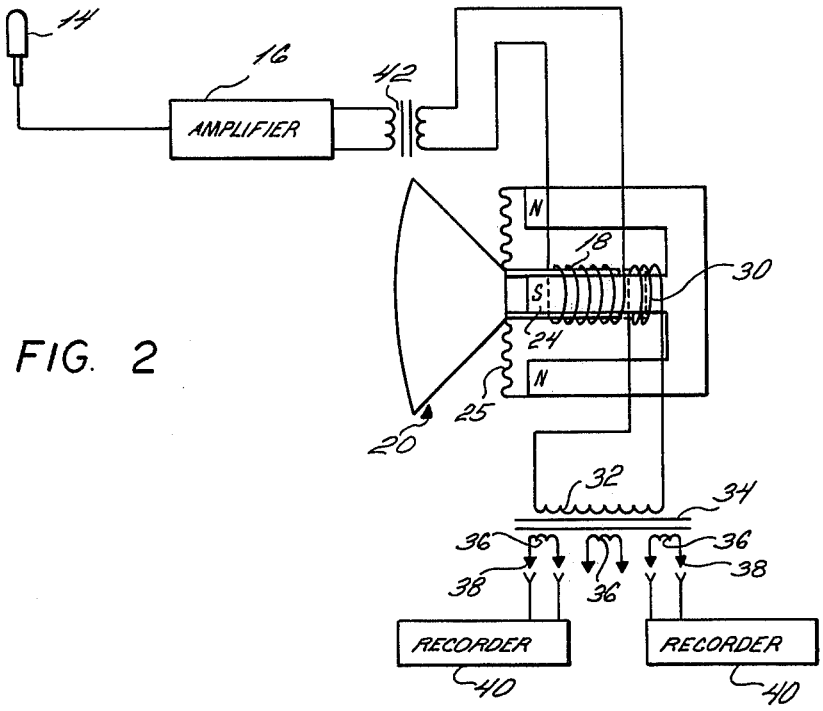

In order to permit a plurality of records to be made simultaneously, it is preferred to provide a multiple tap transformer 34 coupled to auxiliary winding 30 in the speaker. This is illustrated in FIG. 2.

The auxiliary winding 30 is coupled to primary 32 of transformer 34 which is provided with a plurality of secondary windings 36 which may be provided with jacks 38 into which a number of recorders 40 may be connected.

Coupling transformer 42 coupling the amplifier 16 to the voice coil 18 should be selected to provide a proper impedance match.

Design techniques for the speaker and transformer are within the state of the art and are discussed, for example, in *ELEMENTS OF ACOUSTICAL ENGINEERING*, Harry F. Olson-Second Edition, published by D. VanNostrand Company.

In order to provide an efficient coupling means and to minimize the number of turns of wire needed in the pick-up coil it is desirable to utilize the same magnetic core, used by the magnet to create the field acting on the voice coil, as part of the magnetic path coupling the pick-up coil to the voice coil.

Thus, there has been disclosed a method of recording of live performances which permits the cancellation of noises arising from the audience to produce a clear recording. An apparatus for the simultaneously making of multiple recordings has, likewise, been disclosed.

While there have been shown and described and pointed out the fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. The method of recording a primary sound program before a live audience comprising the step of:

a. converting the primary sound program to electrical signals;

b. amplifying the electrical signals;

c. energizing a loud speaker voice coil with the amplified electrical signal;

d. moving said loud speaker voice coil in response to sounds from the audience chamber to generate a magnetic field;

e. positioning a pick-up coil within the magnetic field surrounding the voice coil when the coil is electrically emergized to pick up the electrical signals and signals from the audience; and f. recording the electrical signals induced in the pick-up coil.

2. The method of sound recording a primary sound before a live audience comprising the step of:

a. amplifying the primary sound program;

b. reproducing the amplified primary sound program through a voice coil actuated speaker having a varying magnetic field surrounding said voice coil, the intensity of the field being a function of the signal;

c. picking up sounds from the audience by said speaker;

d. generating an eletrical field about the voice coil responsive to the signals from the audience;

e. positioning an electromagnetic pick-up coil in juxtaposition to said voice coil and electrically coupled thereto to receive signals from said voice coil; and f. recording the signals present in said electromagnetic pick-up coil.

3. In an apparatus for recording sound performances before an audience, employing a microphone and amplifier for amplifying electrical signals from said microphone and a loud speaker, facing the audience, having a diaphragm and a voice coil for actuating the diaphragm responsive to signals from said amplifier and a magnetic field generating means adapted to act on the voice coil, the improvement comprising: a pick-up coil positioned within said magnetic field generated by said magnetic field generating means and adapted to have induced therein electrical signals by a magnetic field generated by electrical signals in said voice coil and including a transformer having a primary and a secondary winding with said primary winding coupled to pick-up coil and said secondary winding adapted to be coupled to recorder means.

4. The apparatus of claim 3 wherein said secondary winding comprises a plurality of independent windings, each adapted for connection to recording means.

* * * * *

UNITED STATES PATENT AND TRADEMARK OFFICE

CERTIFICATE OF CORRECTION

PATENT NO. : 4,025,722

DATED : May 24, 1977

INVENTOR(S) : LEO KARRON

It is certified that error appears in the above-identified patent and that said Letters Patent are hereby corrected as shown below:

Col. 3, Claim 1, line 26, delete "emergized" and substitute therefor --energized--.

Col. 4, Claim 3, line 29, before "pick-up" add --said--.

Signed and Sealed this

*ninth* Day of *August 1977*

[SEAL]

*Attest:*

RUTH C. MASON
*Attesting Officer*

C. MARSHALL DANN
*Commissioner of Patents and Trademarks*